US007178532B2

(12) United States Patent
Kayser

(10) Patent No.: US 7,178,532 B2
(45) Date of Patent: Feb. 20, 2007

(54) FLAT IRON WITH PIVOTING HEADS

(75) Inventor: Karen L. Kayser, Ft. Lauderdale, CT (US)

(73) Assignee: Conair Corporation, Stamford, CT (US)

( * ) Notice: Subject to any disclaimer, the term of this patent is extended or adjusted under 35 U.S.C. 154(b) by 31 days.

(21) Appl. No.: 11/103,761

(22) Filed: Apr. 12, 2005

(65) Prior Publication Data

US 2005/0252519 A1 Nov. 17, 2005

Related U.S. Application Data

(60) Provisional application No. 60/561,314, filed on Apr. 12, 2004.

(51) Int. Cl.
*A45D 1/00* (2006.01)
*A45D 2/00* (2006.01)

(52) U.S. Cl. ..... 132/224; 132/223

(58) Field of Classification Search ..... 132/223, 132/224, 229, 231–234, 263, 269, 271; 219/222–225; D28/35; 606/208, 51
See application file for complete search history.

(56) References Cited

U.S. PATENT DOCUMENTS

| | | | | |
|---|---|---|---|---|
| 3,366,301 | A * | 1/1968 | Mallina | 227/19 |
| 5,308,357 | A * | 5/1994 | Lichtman | 606/205 |
| 6,119,702 | A * | 9/2000 | Habibi | 132/224 |
| 6,820,625 | B2 * | 11/2004 | Park | 132/201 |
| 7,131,971 | B2 * | 11/2006 | Dycus et al. | 606/51 |

* cited by examiner

*Primary Examiner*—Robyn Doan
(74) *Attorney, Agent, or Firm*—Lawrence Cruz; Steven A. Garner

(57) ABSTRACT

A flat iron for styling hair has head portions with heatable inner surfaces that may be pivotally positioned and locked relative to the handle portions to provide enhanced ergonomic comfort and control.

3 Claims, 5 Drawing Sheets

FLAT IRON WITH PIVOTING HEADS

CROSS-REFERENCE TO RELATED APPLICATIONS

This application claims priority to U.S. Provisional Patent Application Ser. No. 60/561,314 filed on Apr. 12, 2004, incorporated herein by reference in its entirety.

BACKGROUND OF THE INVENTION

1. Field of the Invention

The present invention relates to devices for styling hair such as flat hot irons and, more particularly, to such devices that are provided with adjustable position components to enhance ergonomics and control.

2. Description of Related Art

Typical flat irons comprise two pivotally hinged handles, hinged at one end, and having heated heads extending from each handle. The heads have inner surfaces that face each other and that are comprised of a heatable material, usually metal, for straightening or styling hair. An electric heater element located beneath each heatable surface is activated to warm the surfaces to a desired temperature. Then the inner surfaces are positioned around a strand of hair to be styled, and the hinged handles are closed toward each other, thus bringing the heated inner surfaces toward each other to close around the hair strand. The gripped handles are then slid relative to the strand of hair, so as to run along it until the strand exits from between the heads.

Common designs are made with the paddles extending longitudinally from the handles, so as to share a common longitudinal axis with the handles. This design is partly due to conventional belief in ergonomic simplicity and economics in manufacture and packaging.

Among the drawbacks of such design, however, are discomfort and comprised safety due to the need for a user, particularly applying the device to one's self instead of another person's hair, requires a user to bend the wrist of the hand holding the appliance. This causes fatigue and discomfort over prolonged periods. Potentially, if a user continues using the product in such an instance, control of movement is diminished.

It is desirable, therefore, to provide a flat iron appliance that overcomes the shortcomings of the known devices, including one that improves ergonomic comfort and control.

OBJECT AND SUMMARY OF THE INVENTION

It is an object of the present invention to overcome the shortcomings of the prior art mentioned above. These and other objectives are achieved by the present invention described herein.

The present invention achieves the above-mentioned objects by utilizing a design in which the heads are pivotable relative to the handles about an axis generally perpendicular to the flat heated surfaces of the heads. The heads can be locked into a particular position with the use of a button and detents located on the heads and handles.

BRIEF DESCRIPTION OF THE DRAWINGS

The present invention is more fully understood by reference to the following detailed description of an illustrative embodiment with the drawings identified below.

DETAILED DESCRIPTION OF THE INVENTION

Figure 1:
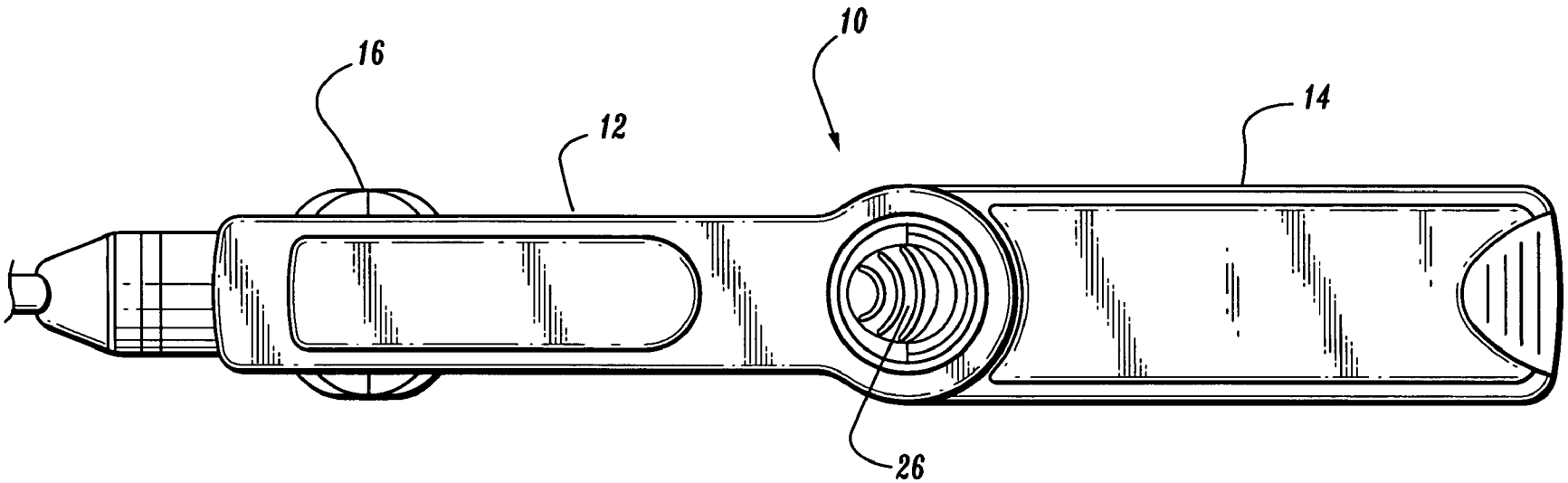
FIG. 1 is a top view image of a device according to the present invention showing heads in an un-pivoted position.
Figure 2:
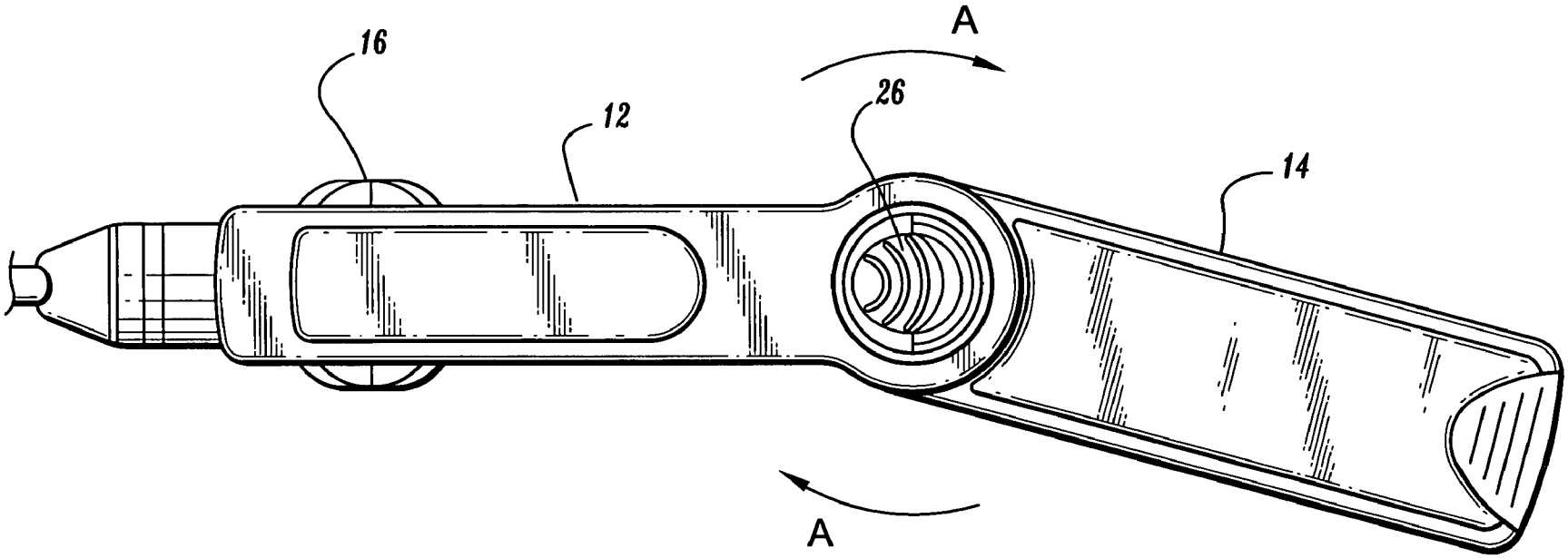
FIG. 2 is a top view image of a device according to the present invention showing heads in a pivoted position.
Figure 3:
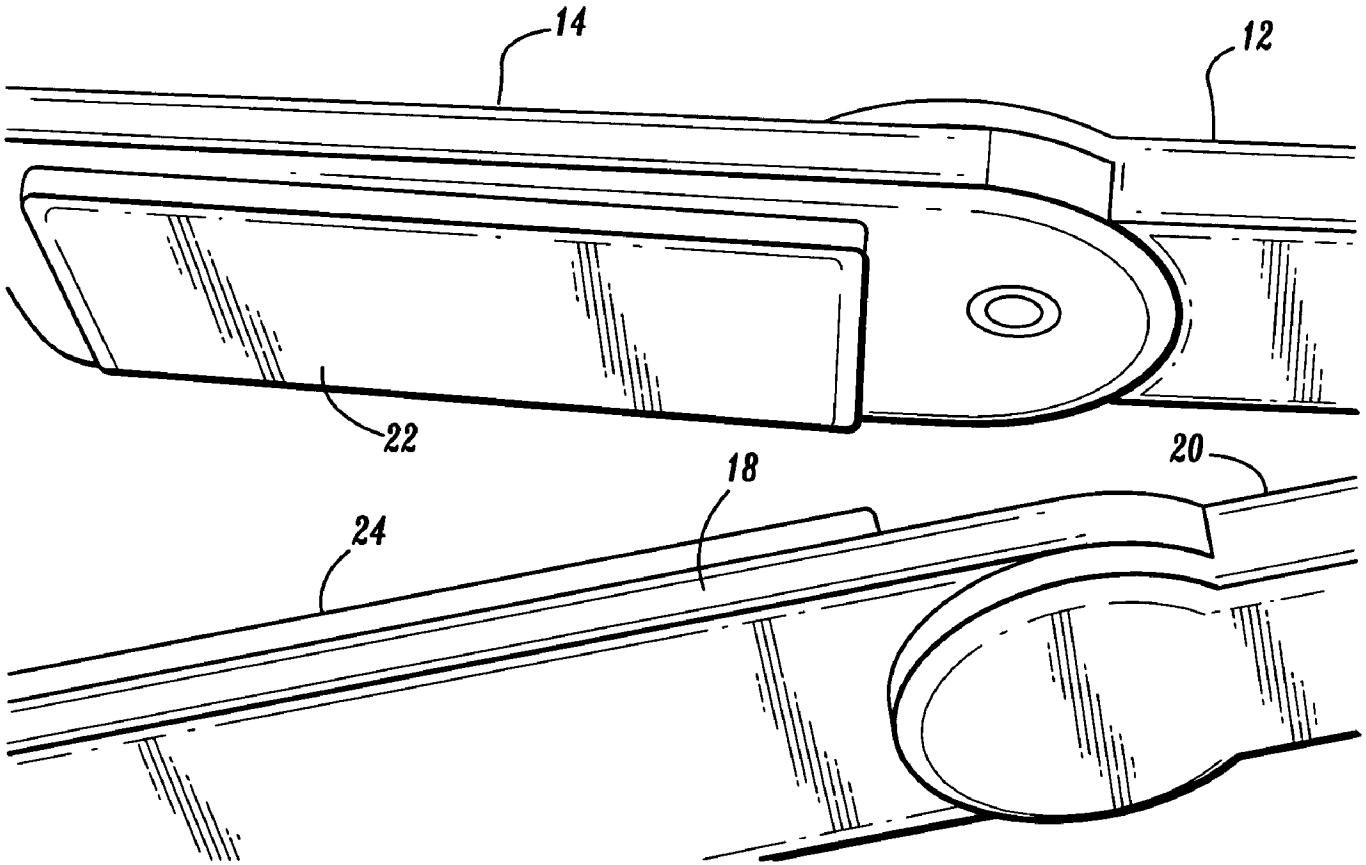
FIG. 3 is a partial perspective view of the head portions of the present invention.

Referring to FIGS. 1–3, a flat iron device 10 has a handle portion 12 and a head portion 14 joined by a spring-biased hinge 16, of a conventional type, to another head portion 18 and handle portion 20. The handle portions 12, 20 are biased away from each other by the spring-biased hinge 16, as is known in the art. Each head portion 14, 18 has a heatable plate 22, 24, heated by conventional electrical means (not shown) known in the art, so that hair can be positioned therebetween for styling. The handles 12, 20 can contain control buttons 17 to operate the device 10.

According to a novel aspect of the present invention, each head 14, 18 is pivotally attached to its respective handle portion 12, 20 to pivot relative to the handle as shown by the arrows (A) in FIG. 2. A conventional hinge and lock may be provided to lock the heads in position. A button 26 may be provided on each handle to selectively lock or unlock each head in position relative to its handle.

Figure 4:
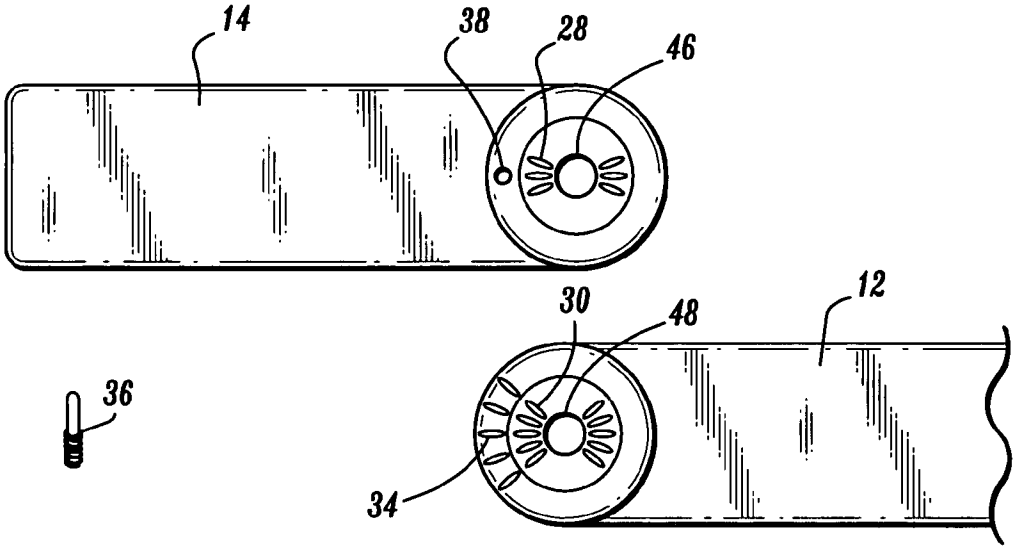
FIG. 4 is a partial view of the outside of a head portion and the inside of a handle portion according to a preferred embodiment of the present invention.
Figure 5:
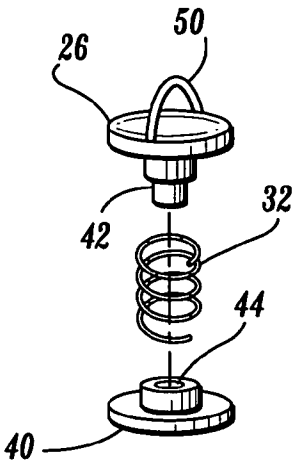
FIG. 5 is a perspective view of a locking mechanism according to a preferred embodiment of the present invention.
Figure 6:
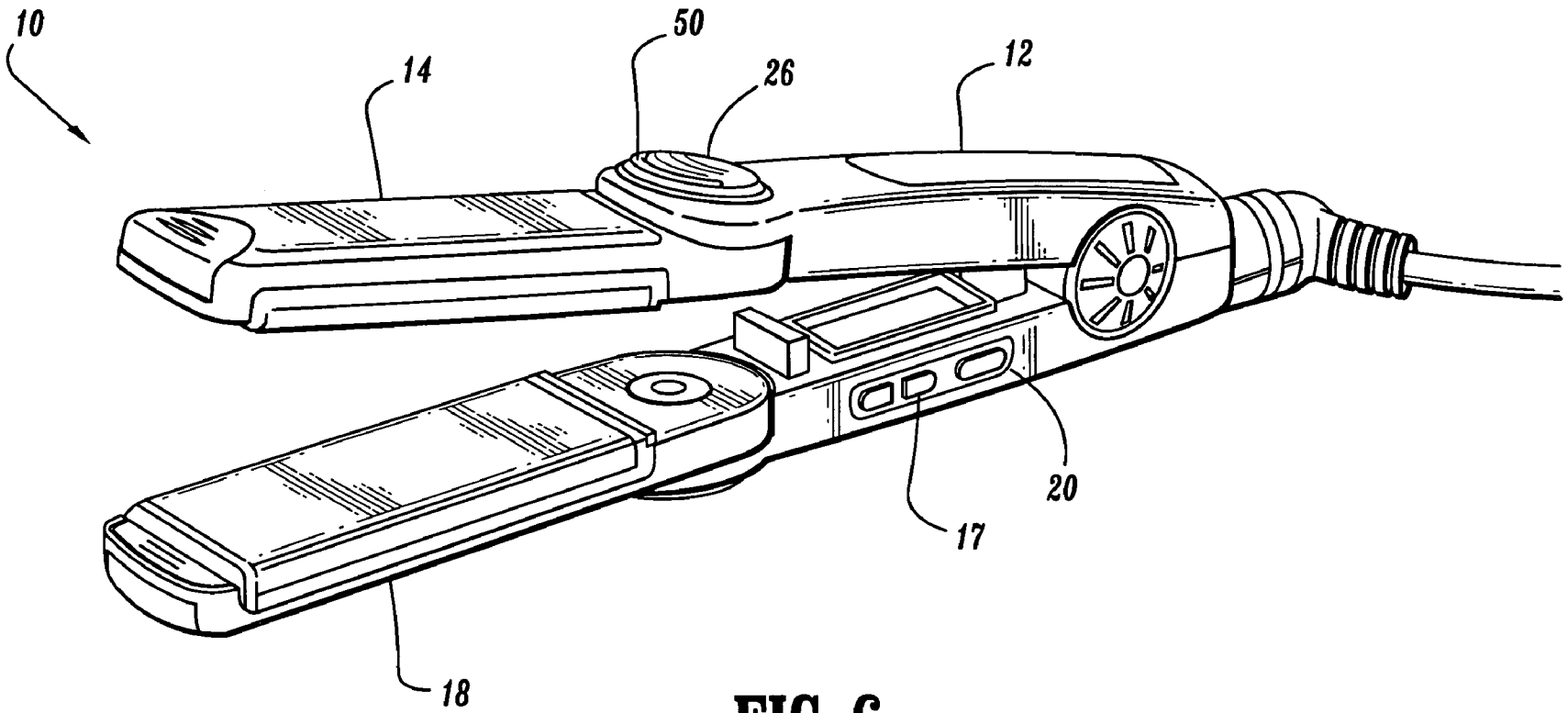
FIG. 6 is a perspective view of a device according to the present invention.

A preferred embodiment of the present invention is illustrated in FIGS. 4 and 5. FIG. 4 shows the outside of a head portion 14 and the inside of a handle portion 12. The head 14 can be placed in one of five different positions in relation to the handle 12 through a set of outer detents 34 located on the handle 14. A spring biased pin 36 can be located in a pinhole 38, whereby the pin 36 can allow for movement between the head 14 and the handle 12 and snap into position at various angles about an axis generally perpendicular to the flat heated surfaces of the heads 14, 18, such as 0°, 15° to either side of the handle, or 30° to either side of the handle, for example.

The end of the head portion 14 nearest the handle portion 12 can have head detents 28 that can complement handle detents 30 located on the inside of the handle portion 12 on the end that connects to the head portion 14. The two sets of detents 28, 30 can be biased away from one another by a spring 32 as shown in FIG. 5.

The position can be locked with a button 26 located on the outside of handle 12 on the end nearest the head 14. A corresponding knob 40 can be located on the inside of the head 14 to interlock with the button 26. This interlocking function can be accomplished by having a protrusion 42 extending from the button 26 and a hole 44 within the knob 40, both with matching surfaces in the form of a hexagon, for example, or any other matching shape. The protrusion 42 and the hole 44 can be interlocked through openings 46, 48 on the head 14 and handle 12. As the button 26 is rotated, the knob 40 is rotated along with it. A user can rotate the button 26 through the use of a semi-circular ring 50 located on the button 26. However, any other method to rotate the button 26 may also be used. Grooves on the inside of the head 14 and the knob 40 cause the knob 40 and the button 26 to be squeezed together, thereby causing the head detents 28 and the handle detents 30 to intermesh and lock together. This prevents the head 14 from being rotated in relation to the handle 12. To unlock the position, the button 26 is rotated in the opposite direction. This causes the knob 40 to also rotate and enable the detents 28, 30 to unmesh, allowing for rotation between the head 14 and the handle 12.

The heatable surfaces of the heads may be any of metal, ceramic, ceramic-coated materials, glass, or other heatable surfaces.

While a preferred embodiment of the invention has been herein disclosed and described, it is understood that various modifications can be made without departing from the scope of the invention.

What is claimed is:

1. A hair styling device comprising a first handle and a second handle; a first head extending from said first handle and having a first heater within said first head, a second head extending from said second handle and having a second heater within said second head, a hinge connecting said first handle and second handle, wherein said first and second heads are adapted to pivot relative to said first and second handles about an axis generally perpendicular to a longitudinal axis of said first and second handles and wherein said first and second heads are selectively positioned in any one of a plurality of preset pivot positions by application a force to said first and/or said second head; and a button located on each of said handles on the end nearest of each of said heads to selectively lock said first and second heads in any one of said plurality of preset pivot positions.

2. A hair styling device according to claim 1, further comprising a plurality of detents located on said first and second heads and said first and second handles to prevent said first and/or said second head from pivoting when said button is locked.

3. A hair styling device according to claim 2, further comprising a second spring adapted to bias said head detents and said handle detents away from each other in an unlocked position.

* * * * *